US005946924A

United States Patent [19]

Kim

[11] Patent Number: 5,946,924

[45] Date of Patent: Sep. 7, 1999

[54] AUTOMATIC ICEMAKER FOR A REFRIGERATOR

[75] Inventor: Byung-Soo Kim, Incheon, Rep. of Korea

[73] Assignee: Daewoo Electronics Co. Ltd., Seoul, Rep. of Korea

[21] Appl. No.: 09/023,486

[22] Filed: Feb. 13, 1998

[30] Foreign Application Priority Data

Jun. 30, 1997 [KR] Rep. of Korea ..... 97-29916

[51] Int. Cl.[6] ..... F25C 1/12

[52] U.S. Cl. ..... 62/189; 62/353; 62/348

[58] Field of Search ..... 62/135, 189, 348, 62/353

[56] References Cited

U.S. PATENT DOCUMENTS 4,848,102 7/1989 Stanfill ..... 62/348

4,872,317 10/1989 Reed ..... 62/189

5,177,980 1/1993 Kawamoto et al. ..... 62/353

*Primary Examiner*—William E. Tapolcai

*Attorney, Agent, or Firm*—Pillsbury Madison & Sutro LLP

[57] ABSTRACT

An automatic icemaker for a refrigerator. The icemaker has an ice tray, an ice receiving container for receiving ice pieces formed in the ice tray, a water reservoir for storing a water to be supplied to the ice tray, a pump installed at one side of the water reservoir, a supply hose for guiding a water pumped by the pump to the ice tray, an overflow hose for recirculating a water overflowing from the ice tray to the water reservoir, and a sensor for detecting the overflowing water by making contact with the overflowing water and sending an electric signal to an ECU so as to stop a water supply. The pump continuously supplys a water to the first vessel, and when the sensor makes contact with the water, the sensor sends an electric signal to the ECU and the ECU stops an operation of the pump. The icemaker continuously supplys water until the water fills up the ice tray so that the control circuitry thereof is simple, and guides the overflowing water to the water reservoir so that the forming of an unnecessary ice in an ice making compartment is avoided.

7 Claims, 3 Drawing Sheets

AUTOMATIC ICEMAKER FOR A REFRIGERATOR

BACKGROUND OF THE INVENTION

1. Field of the Invention

The present invention relates to a refrigerator, and more particularly to an automatic icemaker which can recirculate a water overflowing from an ice tray to a water reservoir while a water supply cycle is being carried out.

2. Description of the Prior Art

Generally, a refrigerator comprises an automatic icemaker which periodically carries out a water supply cycle for supplying a water to be frozen into an ice tray, an ice making cycle for freezing the water in the ice tray, and an ice removing cycle where the ice tray is reversed by a driving device, an ice formed therein is dropped into an ice receiving container and the ice tray is returned into an initial position.

FIG. 1 shows a perspective view showing a conventional automatic icemaker 100 of a refrigerator. As shown in FIG. 1, automatic icemaker 100 comprises an ice tray 130 for receiving a water to be frozen, an ice receiving container 140 for receiving ice pieces formed in ice tray 130, a water supply device 160 for supplying a water to ice tray 130 and a water supply hose 150. Ice tray 130 is installed at a predetermined position in a freezer compartment 110. In ice tray 130, a plurality of partitions 134 are provided in order to separate an inner space of ice tray 130 into a plurality of subspaces. Ice tray 130 is formed at a center position of one side wall thereof with a rotating shaft 132 integrally extending and being assembled with a driving device(not shown). Ice tray 130 has a box shape, of which an upper portion is opened. Below ice tray 130, ice receiving container 140 is located. While an ice removing cycle is being carried out, ice tray 130 is rotated by the driving device and an ice formed therein is dropped into ice receiving container 140. Ice receiving container 140 has a volume larger than that of ice tray 130 so as to stably receive the ice pieces formed in ice tray 130.

Water supply device 160 is installed at a predetermined position of an upper portion of a refrigerating compartment 120 and comprises a water reservoir 170 for storing a water to be supplied into ice tray 130 and a pump 172 installed at one side of water reservoir 170 for pumping the water stored in water reservoir 170.

Automatic icemaker 100 comprises a water supply hose 150 for guiding the water pumped by pump 172. Water supply hose 150 has a one end connected to pump 172 and an other end extending upward and being located above ice tray 130 so as to communicate with ice tray 130.

Meanwhile, water reservoir 170 is fluidly communicated with a water tank(not shown). A water level of water reservoir 170 is maintained at the same level as a water level of the water tank by a valve(not shown). A water supplying to the water tank is manually carried out.

In conventional automatic icemaker 100 having an above-mentioned structure, the water supplying begins by an actuation of pump 172. When a predetermined amount of water is supplied to ice tray 130, the water supply cycle stops and the ice making cycle starts. At this time, the water in ice tray 130 is frozen so as to form ice pieces. After the water is entirely frozen into the ice pieces, ice tray 130 is rotated by the driving device and the ice pieces fall down into ice receiving container 140. Thereafter, the water supply cycle starts again.

Meanwhile, a temperature detecting sensor 136 is installed at an underside of ice tray 130. If sensor 136 detects a temperature which is lower than a predetermined temperature within a predetermined time after the water supply cycle starts by pump 172, sensor 136 sends an electric signal to an ECU(not shown). At this time, the ECU judges that the water supplying is failed and controls water supply device 160 so as to supply again the water after a predetermined time. If sensor 136 detects that the temperature is below the predetermined temperature within the predetermined time after the water supply cycle starts again, sensor 136 sends an electric signal to the ECU and the ECU judges that there is an error at water supply device 160 and eventually stops automatic icemaker 100.

Water supply device 160 further comprises a water detecting rod 174 to detect an existence of water in water reservoir 170 before the water supply cycle starts. Water detecting rod 174 detects whether a water exists in water reservoir 170 or not, and when it detects that the water does not exist, it sends an electric signal to the ECU. Then the ECU keeps water supply device 160 inactivated and keeps it wait until a water is supplied into water reservoir 170 and the water is detected by water detecting rod 174.

However, as mentioned above, since conventional automatic icemaker 100 is operated only when a water exists in water reservoir 170, an additional circuitry for detecting the existence of the water and accordingly, for controlling icemaker 100, is required. In addition, when a lump of ice in which the ice pieces are connected above upper edges of partition walls 134 in ice tray 130 is formed, the lump of ice is not easily removed, and also in this case, the water is again supplied to ice tray 130, so the water overflows from ice tray 130.

Meanwhile, U.S. Pat. No. 4,848,102 issued to Ted M. Stanfill discloses an automatic icemaker which can circulate the water overflowing from the ice tray to the water reservoir through a coil concentrically disposed in an evaporator. The icemaker can reduce a time required to make ice pieces by lowering a temperature of the water to be supplied to the ice tray, but a structure thereof is complicated.

SUMMARY OF THE INVENTION

The present invention is intended to overcome the above described disadvantages. Therefore, it is an object of the present invention to provide an automatic icemaker for a refrigerator which can stably control a water supplying by one sensor and can recirculate an overflowing water from an ice tray to a water reservoir while the water supplying is being carried out.

In order to achieve the above object of the present invention, there is provided an automatic icemaker for a refrigerator having freezer and refrigerating compartments, the icemaker comprising:

- a first vessel for receiving a water to be frozen, the first vessel being installed at a predetermined position of the freezer compartment and being provided therein with a plurality of partitions;
- a second vessel for receiving ice pieces formed in the first vessel, the second vessel being located below the first vessel;
- a third vessel for storing a water to be supplied to the first vessel, the third vessel being installed at a predetermined position of the refrigerating compartment;
- a means for supplying the water stored in the third vessel to the first vessel;
- a first conduit for guiding a water overflowing from the first vessel to the third vessel; and a sensor for detecting the overflowing water by making contact with the overflowing water, the sensor sending an electric signal to an ECU in order to stop the water from being supplied into the first vessel when the sensor detects the overflowing water.

The means includes a pump which is installed at a side of the third vessel in order to pump the water stored in the third vessel, and a second conduit for guiding a water pumped by the pump to the first vessel. The second conduit has a first end connected to the pump and a second end extending upwardly so as to be positioned above the first vessel.

The first conduit has a first end which is connected to a hole formed at an upper side wall of the first vessel corresponding to upper edges of the partitions, and a second end which extends downwardly so as to be communicated with an upper portion of the third vessel.

According to the preferred embodiment of the present invention, the first conduit is a flexible conduit.

According to the preferred embodiment of the present invention, the sensor is a couple of electrically conductive materials which are installed at an inner wall of the first conduit and are electrically communicated with each other so as to generate an electric signal by making contact with the overflowing water.

According to the preferred embodiment of the present invention, when the overflowing water is not detected by the sensor within a predetermined time after the pump is actuated, the ECU stops an operation of the icemaker, the predetermined time being a time required to fill up the first vessel with the water.

According to the preferred embodiment of the present invention, the sensor is installed at a bottom of the first conduit adjacent to the first vessel.

The automatic icemaker for a refrigerator according to the present invention can continuously carry out the water supplying until the water fills up the ice tray so that the control circuitry thereof is simple, and can guide the overflowing water to the water reservoir so that the forming of an unnecessary ice in an ice making compartment can be avoided.

BRIEF DESCRIPTION OF THE DRAWINGS

The above object, characteristics and other advantages of the present invention will become more apparent by describing in detail a preferred embodiment thereof with reference to the attached drawings in which.

DESCRIPTION OF THE PREFERRED EMBODIMENT

Hereinafter, a preferred embodiment of the present invention will be explained in detail with reference to the accompanying drawings.

Figure 1:
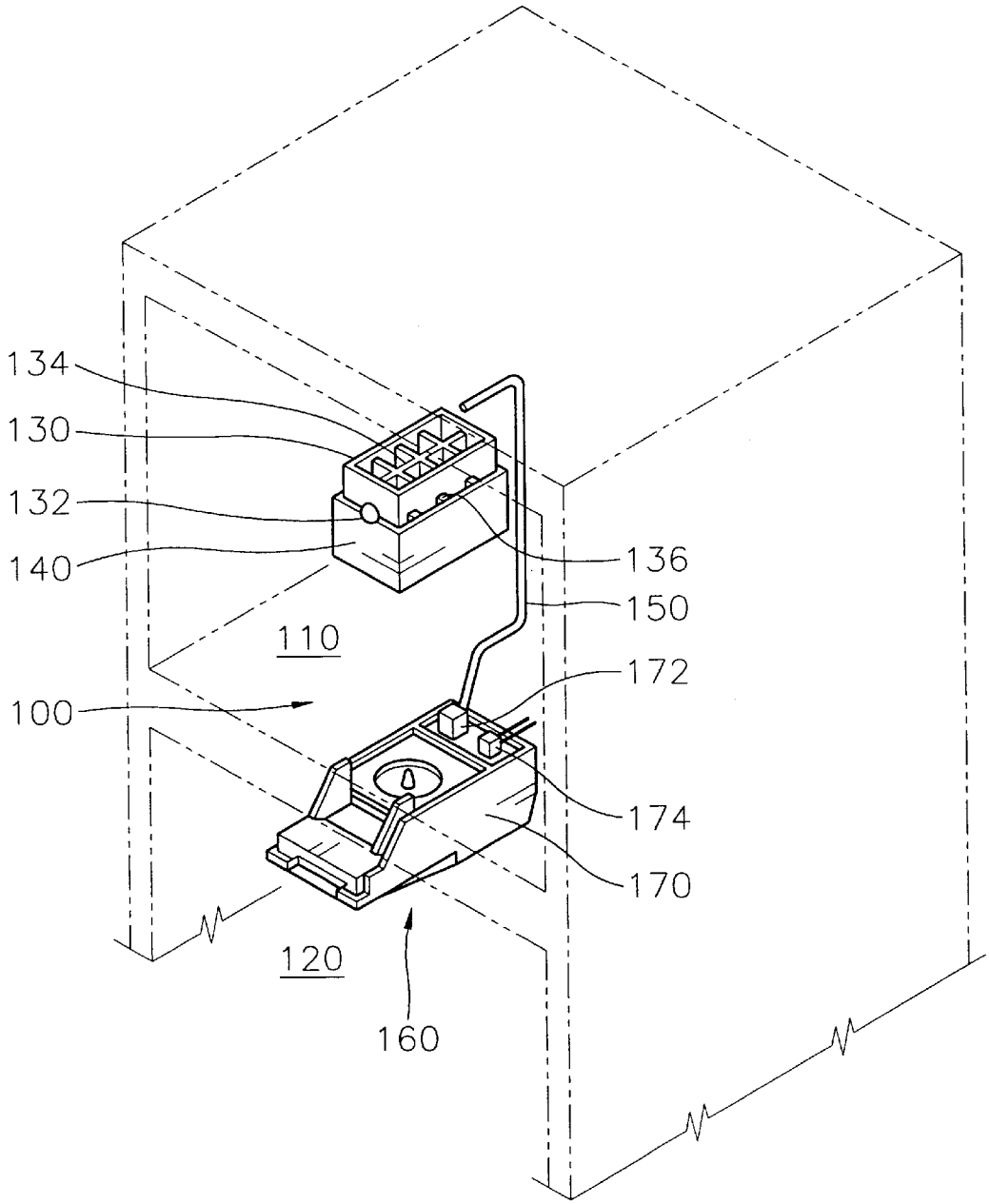
FIG. 1 (PRIOR ART)
FIG. 1 is a perspective view showing a conventional automatic icemaker of a refrigerator.
Figure 2:
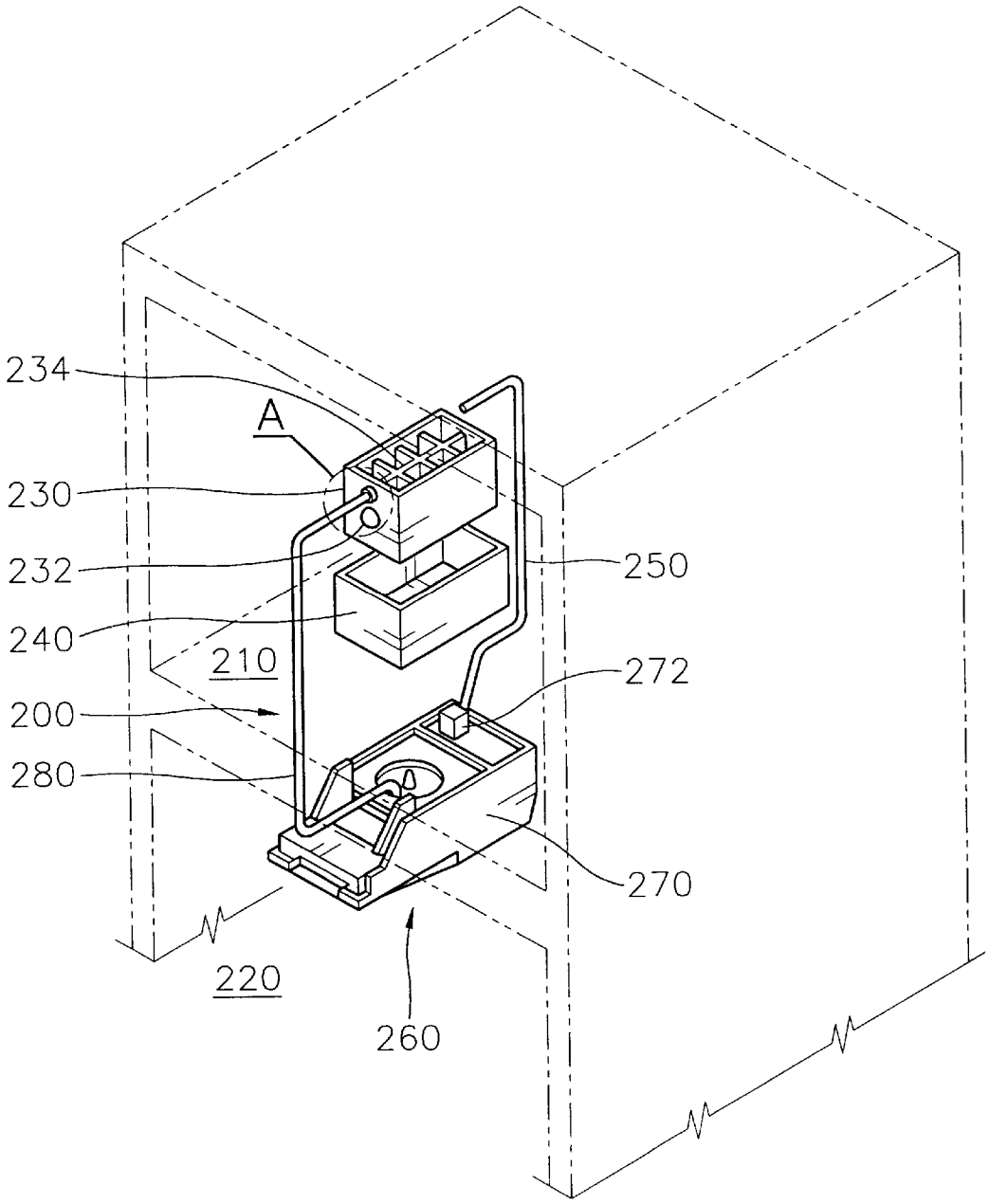
FIG. 2 is a perspective view showing an automatic icemaker of a refrigerator according to the present invention.

FIG. 2 is a perspective view showing an automatic icemaker 200 of a refrigerator according to the present invention. As shown in FIG. 2, automatic icemaker 200 comprises an ice tray 230 for receiving a water to be frozen therein, an ice receiving container 240 for receiving ice pieces formed in ice tray 230, a water supply device 260 for supplying a water to ice tray 230 and a water supply hose 250. Ice tray 230 is installed at a predetermined position in a freezer compartment 210. In ice tray 230, a plurality of partitions 234 are provided in order to separate an inner space of ice tray 230 to a plurality of subspaces. Ice tray 230 is formed at a center position of a side wall thereof with a rotating shaft 232 integrally extending outward and being assembled with a driving device(not shown). Ice tray 230 has a box shape, of which an upper portion is opened. Below ice tray 230, ice receiving container 240 is located. While an ice removing cycle is being carried out, ice tray 230 is rotated by the driving device and an ice formed therein is dropped into ice receiving container 240. Ice receiving container 240 has a volume larger than that of ice tray 230 so as to stably receive ice pieces.

Water supply device 260 is installed at a predetermined position of an upper portion of a refrigerating compartment 220. Water supply device 260 comprises a water reservoir 270 for storing a water to be supplied to ice tray 230 and a pump 272 installed at one side of water reservoir 270 for pumping the water stored in water reservoir 270.

Water supply device 260 further comprises a supply hose 250 for guiding the water pumped by pump 272 to ice tray 230. Supply hose 250 has a one end connected to pump 272 and an other end extending upward and being located above ice tray 230.

Meanwhile, water reservoir 270 is communicated with a water tank(not shown) and maintains its water level at the same level as a water level of the water tank by a valve(not shown). In the water tank, water is manually supplied.

Figure 3:
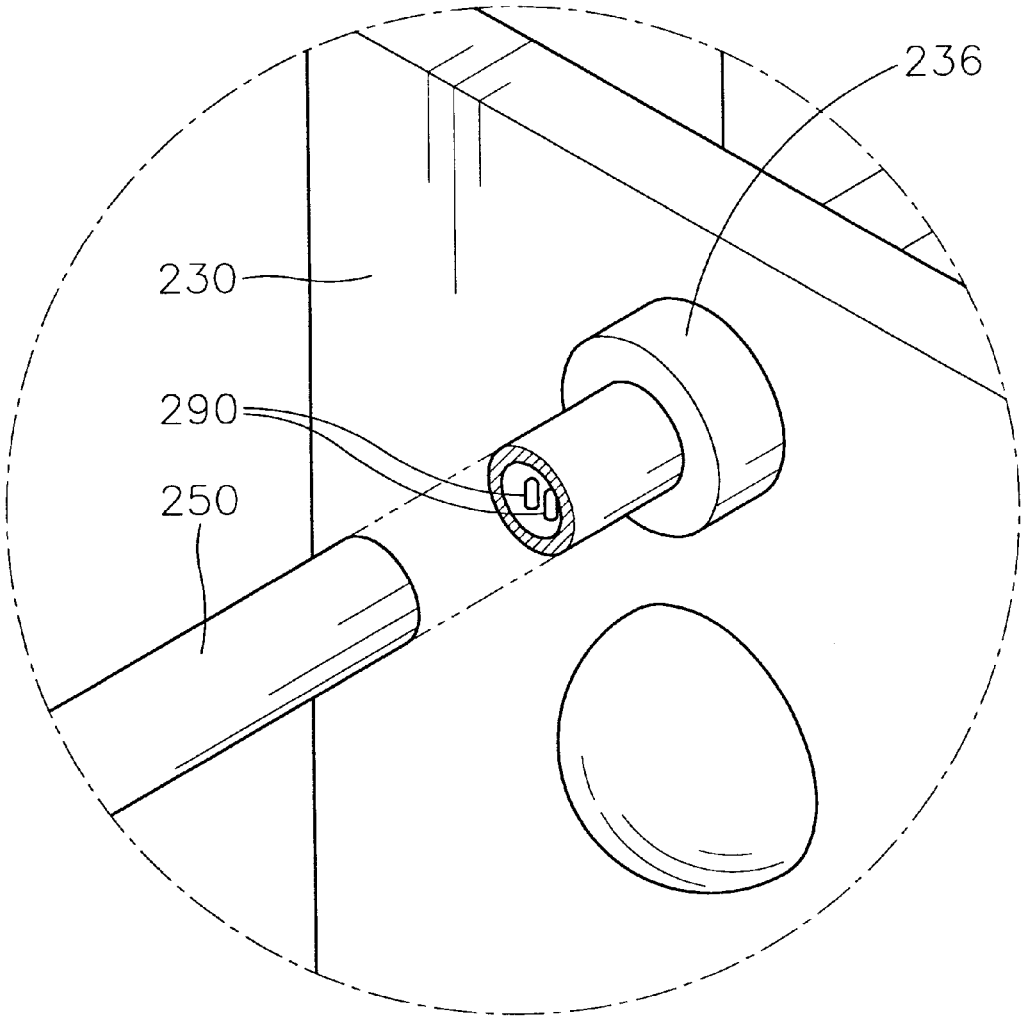
FIG. 3 is an enlarged view of "A" shown in FIG. 2.

While a water supply cycle is being carried out, the water eventually overflows beyond upper edges of partitions 234 in ice tray 230. Automatic icemaker 200 according to the present invention comprises an overflow hose 280 in order to recirculate the overflowing water to water reservoir 270. As shown in FIG. 3, ice tray 230 is formed at one side wall thereof corresponding to upper edges of partitions 234 with a hole 236. Overflow hose 280 has a one end which is connected to hole 236 so as to communicate with ice tray 230 and an other end which extends downwardly so as to communicate with an upper portion of water reservoir 270 so that overflow hose 280 guides the overflowing water to water reservoir 270. A sensor 290 is installed at an inner circumferential wall of overflow hose 280 such that it is positioned adjacent to ice tray 230. When a water flows into overflow hose 280, the flowing water makes contact with sensor 290, and then sensor 290 sends an electric signal to an ECU so as to stop pump 272.

Preferably, overflow hose 280 is flexible so as to move together with ice tray 230 while ice tray 230 is being rotated by the driving device.

Sensor 290 is a couple of electrically conductive materials which electrically communicate with each other when they make contact with the water so as to generate an electric signal and to send the electric signal to the ECU. Preferably, sensor 290 is installed at a bottom-side of the inner wall of overflow hose 280 such that it is positioned adjacent to ice tray 230 so as to make contact with the flowing water regardless of an amount thereof.

Hereinafter, the operation of automatic icemaker 200 for a refrigerator according to the present invention will be described in detail with reference to the accompanying drawings.

In automatic icemaker 200 having the above-mentioned structure, a water is supplied to ice tray 230 by pump 272. When the water overflows from ice tray 230, it makes contact with sensor 290 so as to stop the water supply cycle. Thereafter, an ice making cycle begins so as to form ice pieces in ice tray 230. When the ice pieces are completely formed, ice tray 230 is rotated by the driving device and the ice pieces fall down into ice receiving container 240. Then, the water supply cycle is carried out again. While the water supplying is being carried out, pump 272 is continuously operated until sensor 290 sends an electric signal to the ECU. When the overflowing water is not detected by sensor 290 within a time required to fill up ice tray 230 with the water after pump 272 is actuated, the ECU determines that there is an error in pump 290 or that there is no water in water reservoir 270 and would stop the operation of automatic icemaker 200.

In the conventional automatic icemaker 100, before the water supplying, water detecting rod 174 installed at water supply device 160 detects whether a water exists in water reservoir 170 or not. But, in automatic icemaker 200 according to the present invention, the water supply is only controlled by an activation of sensor 290 regardless of the existence of a water in water reservoir 270, so icemaker 200 does not have the above-mentioned water detecting rod, so a circuitry thereof is simple and the water supplying is started immediately without a pre-detecting procedure.

While the water supplying is being carried out, an excess water is eventually supplied to ice tray 230 and then overflows into overflow hose 280 connected to one side of ice tray 230, so the overflowing water is introduced to water reservoir 270 through overflow hose 280.

At this time, as the overflowing water flows into overflow hose 280, sensor 290 makes contact with the flowing water so as to be electrically activated and to send an electric signal to the ECU. In response to the signal, the ECU stops pump 272 so that the water supply cycle is stopped and starts the ice making cycle.

When the ice making is finished, ice tray 230 is rotated by the driving device so as to drop the ice formed therein down into ice receiving container 240 positioned therebelow.

As described above, the automatic icemaker according to the present invention adapts a mechanism which can continuously supply a water until the water supplying is finished so that the control circuitry thereof is simple, and can guide the overflowing water to the water reservoir so that the forming of an unnecessary ice in an ice making compartment can be avoided.

While the present invention has been particularly shown and described with reference to a particular embodiment thereof, it will be understood by those skilled in the art that various changes and modifications can be made within the scope of the invention as hereinafter claimed.

What is claimed is:

1. An automatic icemaker for a refrigerator having freezer and refrigerating compartments, the icemaker comprising:

a first vessel for receiving a water to be frozen, the first vessel being installed at a predetermined position of the freezer compartment and being provided therein with a plurality of partitions;

a second vessel for receiving ice pieces formed in the first vessel, the second vessel being located below the first vessel;

a third vessel for storing a water to be supplied to the first vessel, the third vessel being installed at a predetermined position of the refrigerating compartment;

a means for supplying the water stored in the third vessel to the first vessel;

a first conduit for guiding a water overflowing from the first vessel to the third vessel; and a sensor for detecting the overflowing water by making contact with the overflowing water, the sensor sending an electric signal to an ECU in order to stop the water from being supplied into the first vessel when the sensor detects the overflowing water.

2. The icemaker according to claim 1, wherein the means includes a pump which is installed at a side of the third vessel in order to pump the water stored in the third vessel, and a second conduit for guiding a water pumped by the pump to the first vessel, the second conduit having a first end connected to the pump and a second end extending upwardly so as to be positioned above the first vessel.

3. The icemaker according to claim 2, wherein the first conduit has a first end which is connected to a hole formed at an upper side wall of the first vessel corresponding to upper edges of the partitions, and a second end which extends downwardly so as to be communicated with an upper portion of the third vessel.

4. The icemaker according to claim 3, wherein the first conduit is a flexible conduit.

5. The icemaker according to claim 3, wherein the sensor is a couple of electrically conductive materials which are installed at an inner wall of the first conduit and are electrically communicated with each other so as to generate an electric signal by making contact with the overflowing water.

6. The icemaker according to claim 3, wherein the pump continuously supplies a water to the first vessel, and wherein when the sensor makes contact with a water, the sensor sends an electric signal to the ECU and the ECU stops an operation of the pump.

7. The icemaker according to claim 1, wherein the sensor is installed at a bottom of the first conduit adjacent to the first vessel.

* * * * *